United States Patent [19]

Takahashi

[11] 4,261,689

[45] Apr. 14, 1981

[54] ELECTRO-MAGNETIC FLUID PUMP

[75] Inventor: Shiro Takahashi, Tokyo, Japan

[73] Assignee: Man Design Co., Ltd., Japan

[21] Appl. No.: 26,407

[22] Filed: Apr. 2, 1979

[30] Foreign Application Priority Data

Feb. 8, 1979 [JP] Japan ..... 54/015617[U]
Feb. 13, 1979 [JP] Japan ..... 54/017291[U]

[51] Int. Cl.[3] ..... F04B 35/04
[52] U.S. Cl. ..... 417/417; 417/550
[58] Field of Search ..... 417/415, 416, 417, 418, 417/550, 551, 553

[56] References Cited

U.S. PATENT DOCUMENTS 4,090,816 5/1978 Takahashi ..... 417/417 X

FOREIGN PATENT DOCUMENTS 1069802 2/1954 France ..... 417/418
2306347 10/1976 France ..... 417/415
1222425 2/1971 United Kingdom ..... 417/416

*Primary Examiner*—Philip R. Coe
*Attorney, Agent, or Firm*—Ostrolenk, Faber, Gerb & Soffen

[57] ABSTRACT

In the construction of an electro-magnetic fluid pump such as an air pump in which a piston assembly carrying an armature is driven for reciprocal axial movement due to operational combination of magnetic attraction generated by a stator core and mechanical spring repulsion for cyclic discharge of the fluid out of its piston chamber, the piston assembly is postively supported on both axial sides of the stator core and a pneumatic spring is incorporated within the piston assembly. Biased movement of the piston assembly and bias in the magnetic attraction are both successfully prevented in order to minimize undesirable abrasion of the piston assembly and its related parts.

8 Claims, 5 Drawing Figures

ELECTRO-MAGNETIC FLUID PUMP

BACKGROUND OF THE INVENTION

The present invention relates to an improved electro-magnetic fluid pump, and more particularly relates to improvement in supporting construction for a reciprocating piston assembly in an electro-magnetic fluid pump such as an air pump in which the piston assembly is alternately driven for movement in one axial direction by magnetic attraction and for movement in the other axial direction by spring repulsion.

The electro-magnetic fluid pump of the above-described type is in general provided with a stator core connected to a given electric power source and a piston assembly carrying an armature. As the stator core is excited, magnetic attraction by the stator core acts on the armature to drive the piston assembly for movement in one axial direction of the pump while overcoming the spring repulsion and resultant lowering in pneumatic pressure caused by increase in volume of a piston chamber admits introduction of the fluid into the piston chamber via one check valve placed in the open state. As the stator core is de-excited due to operation of a rectifier interposed between the stator core and the electric power source, the magnetic attraction disappears the spring repulsion urges the piston assembly on movement in the other axial direction of the pump. Resultant rising in the pressure caused by reduction in volume of the piston chamber admits discharge of the fluid out of the piston chamber via the other check valve placed in the open state. Repeated excitement and de-excitement of the stator core enables the fluid pump to supply the fluid in a cyclic fashion.

With the supporting construction for the piston assembly, in the conventional electro-magnetic fluid pump, the piston assembly is liable to be biased towards either of the magnet poles of the stator core during its reciprocal movement due to the magnetic attraction acting on the armature it carries. This biased magnetic attraction greatly hinders smooth reciprocal movement of the piston assembly, thereby causing serious biased abrasion of its parts which leads to short life of the fluid pump.

In addition to the foregoing disadvantage, the mechanical spring used in the conventional fluid pump tends to assume an off-center biased posture during its compression and recovery from the compression. As the movement of the piston assembly is partly under control of this spring repulsion, the biased posture of the spring often causes biased movement of the piston assembly in a more or less amplified fashion. This undoubtedly accelerates abrasion fatique of the piston assembly and its related parts of the fluid pump.

The stator core usually includes a pair of coil windings mounted to its sections providing the magnet poles. In order to apply uniform magnetic attraction to the armature on the reciprocating piston assembly, the coil windings need to be always maintained at correct positions on the above-described sections. However in practice, vibrations caused by furious reciprocation of the piston assembly tend to cause unexpected displacement of the coil windings on the associated sections. Such displacement of the coil windings naturally causes corresponding disorder in the magnetic attraction acting on the armature on the piston assembly, thereby increasing biased abrasion of the piston assembly and its related parts of the fluid pump.

The piston reciprocates in the piston cylinder with the outer surface of the former in sliding frictional contact with the inner wall of the latter. Since the reciprocation of the piston in the piston cylinder is extremely fast, the piston must generally have a large diameter in order to remain reliably accommodated in the piston cylinder, especially when the magnetic induction field acting on the piston armature is biased in the above described manner. The large area of engagement between the piston and the piston cylinder results in great frictional losses.

SUMMARY OF THE INVENTION

It is one object of the present invention to provide an electro-magnetic fluid pump which is quite free from biased abrasion of the piston assembly and its related parts due to biased magnetic attraction.

It is another object of the present invention to provide an electro-magnetic fluid pump in which the ill influence caused by the biased posture of the spring for urging the piston assembly is greatly enfeebled.

It is another object of the present invention is to provide an electro-magnetic fluid pump in which unexpected displacement of the coil windings on the stator core is well prevented despite vibrations caused by furious reciprocation of the piston assembly.

It is a further object of the present invention to provide an electro-magnetic fluid pump that can operate well with greatly reduced power consumption.

In accordance with the present invention, the reciprocal piston assembly is positively supported on both axial sides of the stator core and a confined air chamber acting as a kind of pneumatic spring is formed in the body of the piston assembly.

DESCRIPTION OF THE PREFERRED EMBODIMENTS

In the following description, the construction and operation of the elements located closer to the fluid introducing end of the pump will be referred to with expressions such as "back", "rear side" or "rearwards", whereas these of elements located closer to the fluid discharging end of the pump will be referred to with expressions such as "front", "fore side" or "forwards".

Figure 1:
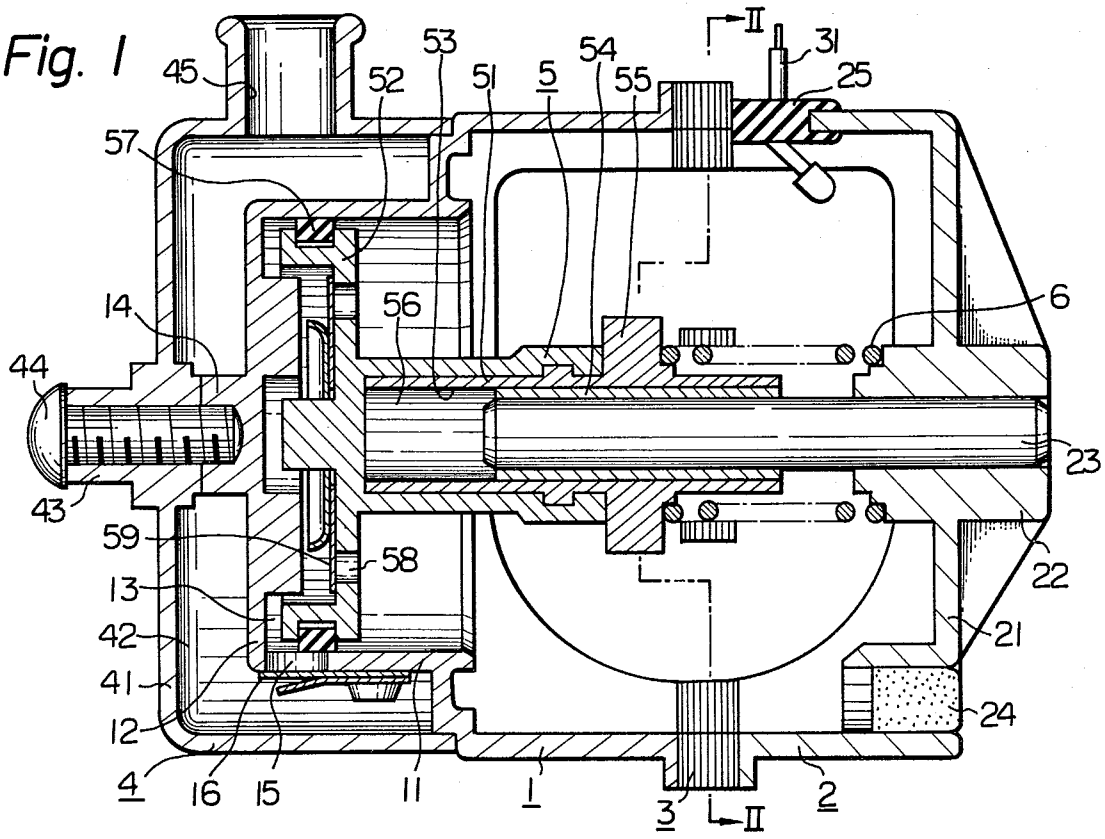
FIG. 1 is a side sectional view of the basic embodiment of the electro-magnetic fluid pump in accordance with the present invention.
Figure 2:
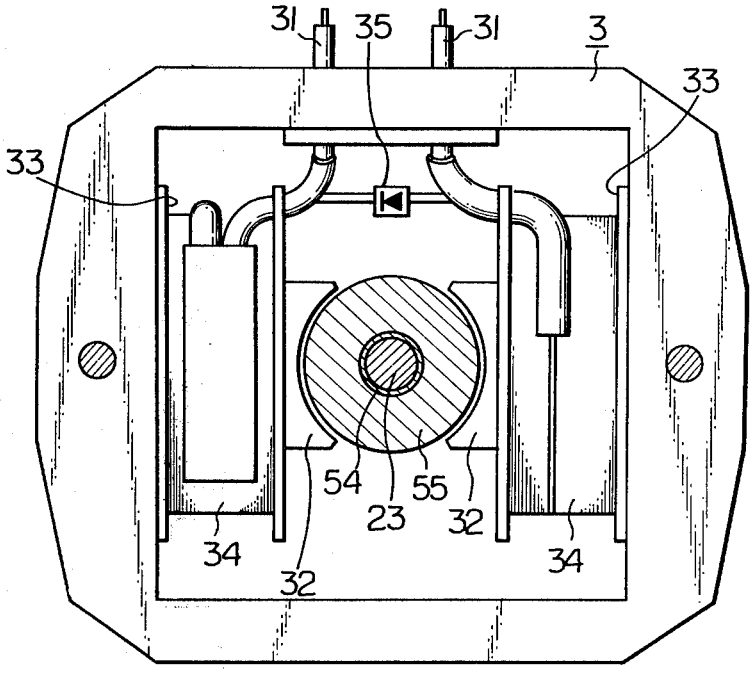
FIG. 2 is a section taken along a line II—II in FIG. 1.

The basic embodiment of the electro-magnetic fluid pump in accordance with the present invention is shown in FIGS. 1 and 2. The housing for the fluid pump is comprised of a cylindrical main front cover 1, a cylindrical main rear cover 2 detachably coupled to the main front cover 1 by suitable known fastening means (not shown) in axial aligment to each other, and a stator core 3 sandwiched between the main front and rear covers 1 and 2. A cylindrical tank cover 4 is detachably coupled to the fore side of the main front cover 1, which defines a later-described tank and is provided with a later-described outlet for discharging the fluid.

The main front cover 1 is provided, on the fore side thereof, a small diametral piston cylinder 11 whose front end is closed by a front closure 12. The piston cylinder 11 internally defines a piston chamber 13. This front closure 12 is provided with a threaded front projection 14 about the center thereof. The piston cylinder 11 is provided with a radial fluid conduit 15 which is closed on the outer side by a check valve 16. This check valve 16 admits passage of the fluid from the piston chamber 13 only.

The main rear cover 2 is closed at the rear end thereof by a back closure 21. The back closure 21 is provided with a center boss 22 which forms a bearing for fixedly supporting a center shaft 23. The center shaft 23 extends in the axial direction of the fluid pump and terminates at a position near the starting position of the above-described piston cylinder 11. At a position near the periphery of the back closure 21, a filter 24 is arranged through the back closure 21 for introduction of the pump fluid. At a position near the stator core 3, a fitting 25 is arranged through the peripheral wall of the main rear cover 2 for admission of electric leads 31 for exciting of the stator core 3.

As shown in FIG. 2, the stator core 3 is made up of a plurality of thin silicon steel plates fastened to each other in a superposed arrangement and has a pair of mutually spaced facing magnet poles 32. Each section of the stator core 3 providing the above-described magnet pole 32 carries a bobbin 33 including a coil winding 34. The coil windings 34 are connected, via a rectifier 35, to a given AC supply source (not shown) by the above-described leads 31. Thus, electric power is supplied to the stator core 3 in the form of pulse signals.

The tank cover 4 is closed at the front end thereof by a front closure 41 and internally defines a fluid tank 42. This fluid tank 42 communicates with the above-described piston chamber 13 via the fluid conduit 15 of the piston cylinder 11 when the check valve 16 is open. The front closure 41 is provided with a threaded center boss 43 at a position corresponding to that of the front projection 14 on the main front center 1. The tank cover 4 is fixed to the front side of the main front cover 1 by a fastening screw 44 screwed into the center boss 43 and the front projection 14. At a position on the peripheral wall, the tank cover 4 is provided with an outlet 45 for discharging the fluid out of the fluid tank 42.

A piston assembly 5 includes a piston 51 and a piston head 52 coupled in one body to the front side of the piston 51. The piston 51 takes the form of an elongated cylindrical body having an axial hole 53 into which a sleeve 54 is snugly inserted. The piston 51 carries a magnetic armature 55 at a position near its rear end. The outer diameter of the armature 55 is designed so that, when the armature 55 is located between the pair of magnet poles 32 of the stator core 3, slight spaces are left between the peripheral surface of the armature 55 and the magnet poles 32. The sleeve 54 is slidably inserted over the center shaft 23 extending forward from the back closure 21 of the main rear cover 2.

The piston head 52 takes the form of a disc which closes the front end of the above-described axial hole 53 of the piston 51. Thus a closed air chamber 56 is formed within the piston assembly 5, which is defined by the peripheral wall of the piston 51, the front end of the center shaft 23 and the piston head 52.

The piston head 52 is slidably inserted into the piston chamber 13 of the main front cover 1 via a seal ring 57. The piston head 52 is provided with at least one fluid conduit 58 formed therethrough. The front end of each fluid conduit 58 is closed by a check valve 59, which admits introduction of fluid into the piston chamber 13 only.

A coil compression spring 6 is interposed between the front face of the center boss 22 and the back face of the armature 55 while spacedly winding around the center shaft 23 in order to always urge the piston assembly 5 on forward movement.

In a fashion later described in more detail, the fluid is introduced into the cavity of the fluid pump via the filter 24 disposed to the main rear cover 2 and then into the piston chamber 13 through the fluid conduit 58 when the check valve 59 on the piston head 52 is open. Upon compression of the fluid in the piston chamber 13, the check valve 16 on the piston cylinder 11 is rendered to open by the raised fluid pressure in the piston chamber 13 in order to admit passage of the fluid through the fluid conduit 15, and the fluid is introduced into the fluid tank 42.

Operation of the fluid pump having the above-described construction is as hereinafter described. In the following example, the fluid pump in accordance with the present invention is used as an air pump which supplies compressed air.

As electric power is supplied to the coil windings 34 of the stator core 3, the latter is excited and the magnetic force generated at the magnet poles 32 attracts the armature 55 on the piston assembly 5. Due to this magnetic attraction, the piston assembly 5 is forced to move rearwards while overcoming repulsion of the compression spring 6. During this movement, the piston 51 slides over the fixed center shaft 23 and the volume of the air chamber 56 is accordingly reduced since the piston head 52 closing the front end of the air chamber 56 moves towards the front end of the center shaft 23 which closes the rear end of the air chamber 56.

As a result of compression on the compression spring 6, the latter stores elastic energy. Concurrently with this, reduction in volume of the air chamber 56 renders the air within the air chamber 56 be compressed to store elastic energy. In other words, the air in the air chamber 56 acts as a kind of pneumatic spring when compressed from its normal state.

As the piston head 52 moves rearwards, the volume of the piston chamber 13 is accordingly increased and the pneumatic pressure inside the piston chamber 13 lowers. This lowering in pneumatic pressure within the piston chamber 13 causes the check valve 59 on the piston head 52 to open to admit introduction of the air in the cavity of the pump into the piston chamber 13 through the fluid conduit 58.

As supply of the electric power to the coil windings 34 is cancelled, the stator core 3 is de-excited and the magnetic attraction acting on the armature 55 of the piston assembly 5 disappears. Then, repulsion of the compression spring 6 and of the above-described pneumatic spring forces the piston assembly 5 to move forwards. With this forward movement, the piston head 52 approaches the front closure 12 of the piston cylinder 11 and the volume of the piston chamber 13 is accordingly reduced. This reduction in volume of the piston chamber 13 naturally raises the pneumatic pressure within the piston chamber 13. Then, the check valve 16 is forced to open in order to admit flow of the air into the fluid tank 42 through the fluid conduit 15.

As is clear from the foregoing description, repeated excitement and de-excitement of the stator core 3 causes repeated rising and lowering of the pneumatic pressure within the piston chamber 13, thereby enabling cyclic supply of compressed air by the fluid pump in accordance with the present invention.

Figure 3:
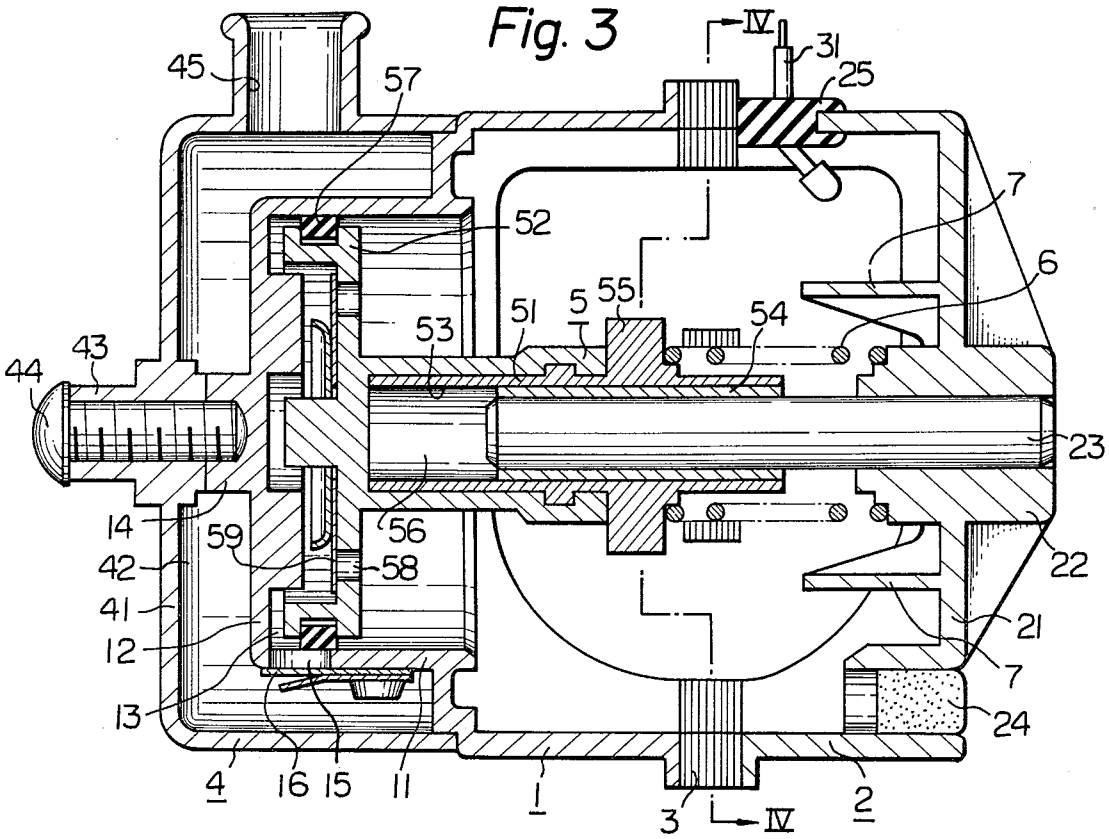
FIG. 3 is a side sectional view of a modified embodiment of the electro-magnetic fluid pump in accordance with the present invention.
Figure 4:
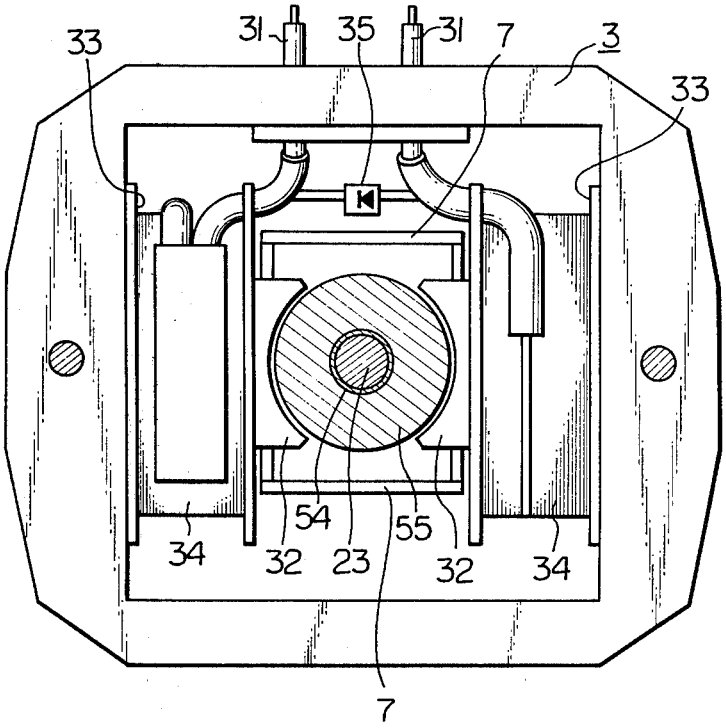
FIG. 4 is a section taken along a line IV—IV in FIG. 3.

A modified embodiment of the fluid pump in accordance with the present invention is shown in FIGS. 3 and 4, in which mechanical elements substantially common in construction and operation to those used in the foregoing embodiments are designated with common reference numerals and explanation thereof is omitted for the purpose of simplicity.

In the case of this embodiment, the main rear cover 2 further includes a pair of horizontal ribs 7 extending forwards from the back closure 21 on both vertical sides of the center boss 22. The ribs 7 both terminate at an axial position near the rear ends of the magnet poles 32 of the stator core 33. The width of the ribs 7 is somewhat smaller than the distance between inner facing ends of the bobbins 33 carrying the coil windings 34.

Other construction of the fluid pump of this embodiment is substantially similar to that of the fluid pump of the foregoing embodiment.

Figure 5:
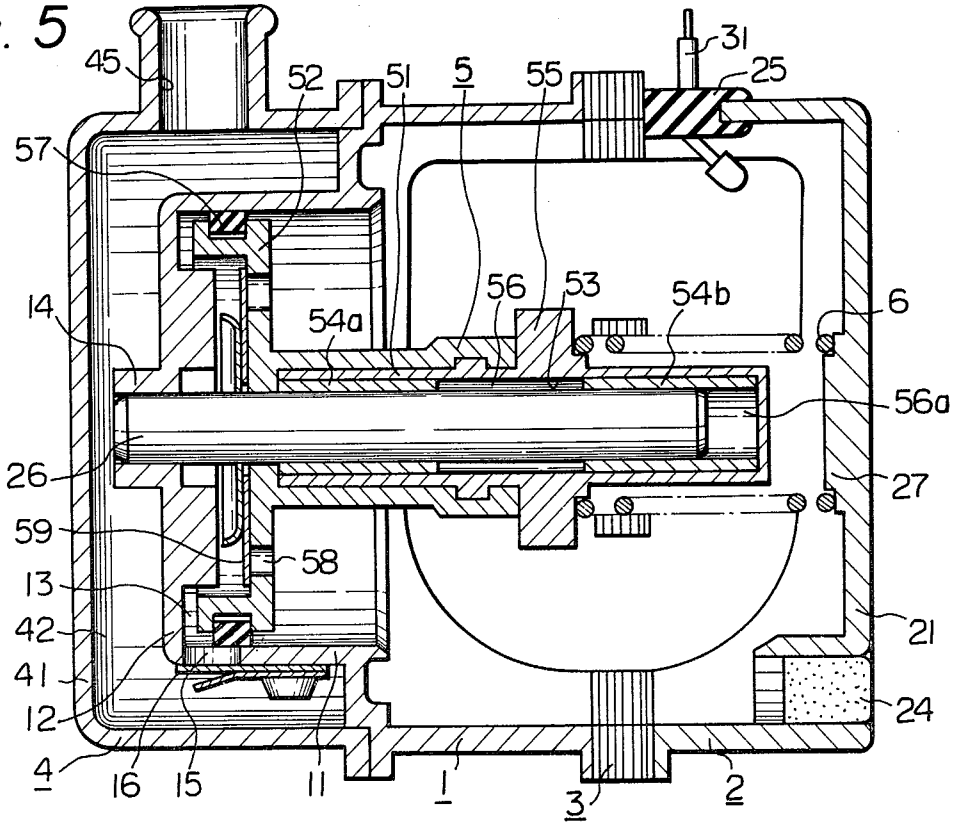
FIG. 5 is a side sectional view of a further modified embodiment of the electro-magnetic fluid pump in accordance with the present invention.

A further modified embodiment of the electro-magnetic fluid pump in accordance with the present invention is shown in FIG. 5, in which parts substantially common to those used in the basic embodiments are designated by common reference symbols.

In the case of this embodiment, a center shaft 26 is securedly supported by the center projection 14 of the piston cylinder front closure 12 and extends rearwards somewhat beyond the rear end of the stator core 3. The piston assembly 5 is slidably inserted over the center shaft 26 via a pair of sleeves **54*a* and 54*b*. At a position beyond the rear end of the center shaft 26, the piston 51 is closed while leaving an air chamber 56*a* inside which is similar in function with the air chamber 56 in the basic embodiment. As a substitute for the center boss 22 used in the basic embodiment, a spring seat 27 is formed on the inside surface of the rear cover back closure 21 in order to receive the rear end of the compression spring 6**.

The following advantages result from application of the present invention to the construction of electro-magnetic fluid pumps.

(a) In accordance with the present invention, the front part of the piston assembly, i.e. the piston head, is slidably received within the piston cylinder, whereas the rear part of the piston assembly, i.e. the piston, is slidably inserted over the fixed center shaft. In other words, the piston assembly is reliably supported on both sides of the armature which is liable to be subjected to biased magnetic attraction by the magnet poles of the stator core. This dual supporting construction prevents biased movement of the piston assembly, thereby remarkably minimizing abrasion of its parts and assuring longer life thereof.

(b) In accordance with the present invention, a pneumatic spring is provided in addition to the mechanical compression spring in order to urge the piston assembly on forward movement. Further, the pneumatic spring is located close to the piston head of the piston assembly. Isotropic repulsion of the pneumatic spring well compensates possible biased repulsion of the mechanical compression spring which may cause amplified biased movement of the piston assembly. Further, as the repulsion by the pneumatic spring anticipates that by the mechanical compression spring, movement of the piston assembly is controlled by the isotropic repulsion by the neumatic spring especially at its starting period.

(c) In accordance with the second embodiment of the present invention, a pair of horizontal ribs are arranged between the bobbins for the coil windings. As the ribs hinder undesirable displacement of the bobbins on the sections of the stator core providing the magnet poles, the coil windings are maintained at correct positions on the stator core, thereby eliminating any unexpected bias in the magnetic attraction actin on the armature of the piston assembly.

(d) The ribs reinforce the back closure of the main rear cover at positions close to the center boss supporting the center shaft. Therefore, the center shaft can be firmly held against any possible biased load acting thereon.

(e) The piston is in sliding frictional contact with the center shaft, and the seal ring of the piston assembly is in sliding frictional contact with the piston cylinder. The power loss due to the contact between the piston cylinder and the seal ring is negligible because the small area of contact between them reduces the friction between the cylinder and the piston assembly. Thus the principal frictional loss occurs because of the friction between the cylindrical portions 53 of the piston and the center shaft, both of which are relatively small in diameter. As a result of the small dimensions of these two elements, their area of contact is naturally relatively small, with the consequence that the power consumed in operating the pump of the invention is considerably reduced.

What is claimed is:

1. An improved electro-magnetic fluid pump, comprising:

a housing;

a stator core located in said housing, said stator core including coil windings for connection to an electric power source and a pair of magnetic poles spaced from and facing each other and defining a space between them, said space having an axis;

a piston cylinder formed in said housing and defining a piston chamber which is coaxial with said space;

at least two check valves annexed to said piston chamber, one said valve allowing introduction of fluid into said piston chamber and the other said valve allowing discharge of fluid out of said piston chamber;

a piston assembly reciprocal in first and second axial directions through said space along said axis, said piston assembly including an armature for moving said piston assembly in said first axial direction in response to a magnetic field generated by said stator core;

supporting means, including a rigid member secured to said housing and extending axially through said space, for supporting said piston assembly on both axial sides of said magnetic poles of said stator core so as to prevent radial motion by any portion of said piston assembly in a direction transverse to said axis of said space while allowing free reciprocal axial movement of said piston assembly; and means for resiliently urging said piston assembly in said second axial direction.

2. An improved electro-magnetic fluid pump as claimed in claim 1, in which said rigid member includes a center shaft having one end secured to said housing and extending axially through said space, and having a second end at a location that is axially between said magnetic poles and said piston cylinder, said center shaft being coaxial with said space; and in which said piston assembly includes a piston head that is slidably received within said piston chamber, and further includes a cylindrical piston coupled to said piston head and slidably inserted over said second end of said center shaft.

3. An improved electro-magnetic fluid pump as claimed in claim 1, in which said rigid member includes a center shaft having one end secured to said piston cylinder, and extending axially through said space, and having a second end at a location such that said magnetic poles are axially between said piston cylinder and said location, said center shaft being coaxial with said space; and in which said piston assembly includes a piston head that is slidably received within said piston chamber, and further includes a cylindrical piston coupled to said piston head and slidably inserted over said second end of said second end of said center shaft.

4. An improved electro-magnetic fluid pump as claimed in claim 2 or 3, in which said means for resiliently urging said piston assembly in said second axial direction includes an air chamber defined by said piston head, said second end of said center shaft and said cylindrical piston.

5. An improved electro-magnetic fluid pump as claimed in claim 2 or 3, in which said one check valve is located in said piston head.

6. An improved electro-magnetic fluid pump as claimed in claim 2 or 3, in which said other check valve is located in said piston cylinder.

7. An improved electro-magnetic fluid pump as claimed in claim 1, further comprising a pair of horizontal ribs secured to said housing and extending in one of said axial directions, and being substantially symmetric with respect to said axis of said space; and further comprising a pair of bobbins spaced apart from each other, and corresponding to respective ones of said magnetic poles and carrying said coil windings; the greatest length of said ribs in a direction transverse to said axis of said space being smaller than the distance between said bobbins.

8. An improved electro-magnetic fluid pump as claimed in claim 1, in which said piston assembly further includes a seal ring which slidably engages said piston cylinder, the engagement between said seal ring and said piston cylinder being the only contact between said piston assembly and said piston cylinder.

* * * * *